US007854093B2

(12) United States Patent
Yoshida et al.

(10) Patent No.: US 7,854,093 B2
(45) Date of Patent: Dec. 21, 2010

(54) AUTOMATIC OPENING/CLOSING APPARATUS FOR VEHICLE

(75) Inventors: Yasushi Yoshida, Kiryu (JP); Yoshitaka Sekine, Kiryu (JP); Yoshitaka Urano, Kiryu (JP); Hiroshi Eguchi, Kiryu (JP); Satoshi Nagamoto, Kiryu (JP)

(73) Assignee: MITSUBA Corporation, Kiryu-shi (JP)

( * ) Notice: Subject to any disclaimer, the term of this patent is extended or adjusted under 35 U.S.C. 154(b) by 415 days.

(21) Appl. No.: 12/022,353

(22) Filed: Jan. 30, 2008

(65) Prior Publication Data

US 2008/0178528 A1 Jul. 31, 2008

(30) Foreign Application Priority Data

Jan. 31, 2007 (JP) ..... 2007-021937

(51) Int. Cl.
*E05F 11/00* (2006.01)

(52) U.S. Cl. ..... 49/360; 296/155

(58) Field of Classification Search ..... 49/360; 296/155

See application file for complete search history.

(56) References Cited

U.S. PATENT DOCUMENTS 5,657,580 A * 8/1997 Kobrehel ..... 49/352
5,737,876 A * 4/1998 Dowling ..... 49/360
5,832,669 A * 11/1998 Mizuki et al. ..... 49/360
5,833,301 A * 11/1998 Watanabe et al. ..... 296/155
5,867,940 A * 2/1999 Watanaba et al. ..... 49/360
5,884,433 A * 3/1999 Watanabe et al. ..... 49/360
5,913,563 A * 6/1999 Watanabe et al. ..... 296/155
6,964,132 B2 * 11/2005 Otomo et al. ..... 49/360
7,269,924 B2 * 9/2007 Otomo et al. ..... 49/506
7,287,804 B2 * 10/2007 Yamagishi et al. ..... 296/155
7,556,577 B2 * 7/2009 Kita et al. ..... 474/117
2004/0195419 A1 * 10/2004 Yamagishi et al. ..... 242/365.6
2009/0019776 A1 * 1/2009 Ohtaki et al. ..... 49/360

FOREIGN PATENT DOCUMENTS

JP 2000-8708 1/2000

* cited by examiner

*Primary Examiner*—Jerry Redman
(74) *Attorney, Agent, or Firm*—McCormick, Paulding & Huber LLP

(57) ABSTRACT

An automatic opening/closing apparatus for vehicle, which is provided with a tensioner mechanism for applying a predetermined tension to a cable member, is downsized. A case of a driving unit is provided with a tensioner housing, and the tensioner mechanism for applying the predetermined tension to a cable is accommodated in the tensioner housing. The tensioner mechanism includes a pulley holder movably mounted on a guide shaft, and a spring for biasing the pulley holder, wherein a movable pulley is rotatably supported by the pulley holder. The cable drawn in the tensioner housing is wound about the movable pulley so that a direction in which the cable is drawn out from the case is substantially parallel to a direction in which the cable is drawn out from a driving drum, whereby the predetermined tension is applied to the cable by a spring force of the spring.

8 Claims, 11 Drawing Sheets

AUTOMATIC OPENING/CLOSING APPARATUS FOR VEHICLE

CROSS REFERENCE TO RELATED APPLICATIONS

This application is entitled to the benefit of and incorporates by reference essential subject matter disclosed in Japanese Patent Application No. 2007-21937 filed on Jan. 31, 2007.

TECHNICAL FIELD OF THE INVENTION

The present invention relates to an automatic opening/closing apparatus for vehicle, which automatically opens and closes an open/close member provided on a vehicle body.

BACKGROUND OF THE INVENTION

Conventionally, a vehicle such as a wagon and a minivan is provided with, at a side part of its body, a sliding door that is opened and closed in vehicle-front and vehicle-back directions, thereby allowing passengers or merchandise to be easily loaded or unloaded from a side direction of the vehicle. This sliding door can normally be opened and closed by a manual operation. However, in recent years, there is also often found such a vehicle that the automatic opening/closing apparatus is mounted on the vehicle to automatically open and close the sliding door.

This automatic opening/closing apparatus is known as a cable type in which a cable (cable member) connected to the sliding door from the vehicle-front and vehicle-back directions is guided to a driving unit disposed in the vehicle body via reverse pulleys disposed at both ends of a guide rail; the cable is wound around a driving drum (driving rotor) provided to the driving unit; and this drum is driven for rotation by a driving source such as an electric motor so that the sliding door is automatically opened and closed while being drawn by the cable.

In the cable type automatic opening/closing apparatus, when the sliding door is guided along a curve portion of the guide rail and is drawn inside the vehicle body, length of a movement path of the cable is changed, so that a tensioner mechanism is required to absorb the change in the length of the movement path of the cable. For example, Patent Document 1 (Japanese Patent Application Laid-Open No. 2000-8708) discloses a tensioner mechanism comprising a pair of movable pulleys movably mounted on a tension case in a direction of approaching or separating from each other, and a coil spring for biasing the movable pulleys in a direction in which the movable pulleys are brought close to each other, wherein the cable drawn out from the drum is bridged about each of the corresponding movable pulleys.

SUMMARY OF THE INVENTION

However, in the tensioner mechanism disclosed in Patent Document 1, because a direction in which the cable is moved between the drum and the movable pulley is largely inclined with respect to a direction in which each of the movable pulleys is moved, an angle at which the cable is drawn out from the drum is changed according to movement of the movable pulley. For this reason, it is necessary that a moving space depending on the change in the angle of the cable is ensured between the drum and the movable pulley, which results in hindrance of downsizing the automatic opening/closing apparatus.

Additionally, when the direction in which the cable is moved between the drum and the movable pulley is largely inclined with respect to the direction in which each of the movable pulleys is moved, since a change in a tension of the cable is made small with respect to an movement amount of the movable pulley, there has been such a problem that it becomes difficult to set a spring force of the coil spring.

An object of the present invention is to downsize an automatic opening/closing apparatus for vehicle, which is provided with a tensioner mechanism for applying a predetermined tension to the cable member.

An automatic opening/closing apparatus for vehicle according to the present invention is an apparatus, which automatically opens and closes an open/close member provided in a vehicle body, and comprises: a case disposed in the vehicle body; a driving rotor rotatably accommodated in the case; a driving source attached to the case to drive the driving rotor for rotation; a cable member whose one end side is wound about the driving rotor and whose other end is connected to the open/close member; and a tensioner mechanism accommodated in the case to apply a predetermined tension to the cable member, wherein the tensioner mechanism comprises: a guide shaft supported by the case along a direction in which the cable member is derived from the case; a pulley holder movably supported (installed) on the guide shaft along the guide shaft; a movable pulley rotatably supported by the pulley holder, the cable member being wound about the movable pulley so that a direction in which the cable member is derived from the driving rotor is substantially parallel to a direction in which the cable member is drawn out from the case; and a spring member supported (installed) on the guide shaft to bias the pulley holder toward a direction of applying a tension to the cable member.

The vehicle automatic opening/closing apparatus for vehicle according to the present invention further comprises: an open-side tensioner mechanism for applying a predetermined tension to an open-side cable member connected to the open/close member from its open side; and a close-side tensioner mechanism for applying a predetermined tension to a close-side cable member connected to the open/close member from its close side, wherein the tensioner mechanisms are disposed in the case adjacently to each other.

The vehicle automatic opening/closing apparatus for vehicle according to the present invention further comprises arc guide walls provided in the pulley holder so as to oppose to each other and so that the arc guide walls have a predetermined space in an outer circumferential surface of the movable pulley, wherein the tensioner mechanisms are disposed in the case so that the guide walls are brought close to each other.

The vehicle automatic opening/closing apparatus for vehicle according to the present invention is such that the tensioner mechanism is assembled to the case while being previously unitized.

According to the present invention, the movable pulley is disposed so that a direction in which the cable member is drawn out from the driving pulley is substantially parallel to a direction in which the cable member is drawn out from the case, and the movable pulley is moved in parallel to the direction in which the cable is drawn out from the case, so that the change in the angle in the direction in which the cable member is drawn out when the movable pulley is operated can be reduced. Accordingly, a moving space of the cable member involved in the operation of the movable pulley can be reduced, whereby the automatic opening/closing apparatus for vehicle can be downsized.

According to the present invention, the open-side tensioner mechanism for applying the tension to the open-side cable member and the close-side tensioner mechanism for applying the tension to the close-side cable member are provided and disposed in the case adjacently to each other. Therefore, the spaces where the tensioner mechanisms are disposed can be reduced, whereby the automatic opening/closing apparatus for vehicle can be downsized. In this case, since the guide walls for preventing the cable member from being released from the movable pulley are provided in the respective tensioner holders, the tensioner mechanisms can be disposed adjacently to the case so that the guide walls are brought close to each other.

According to the present invention, the tensioner mechanism is assembled to the case while being previously unitized, so that work for assembling the tensioner mechanism to the case can easily performed.

BRIEF DESCRIPTION OF THE DRAWINGS

FIG. 1 is attached to a vehicle body;

DESCRIPTION OF THE PREFERRED EMBODIMENTS

An embodiment according to the present invention will be described in detail below with reference to the drawings.

Figure 1:
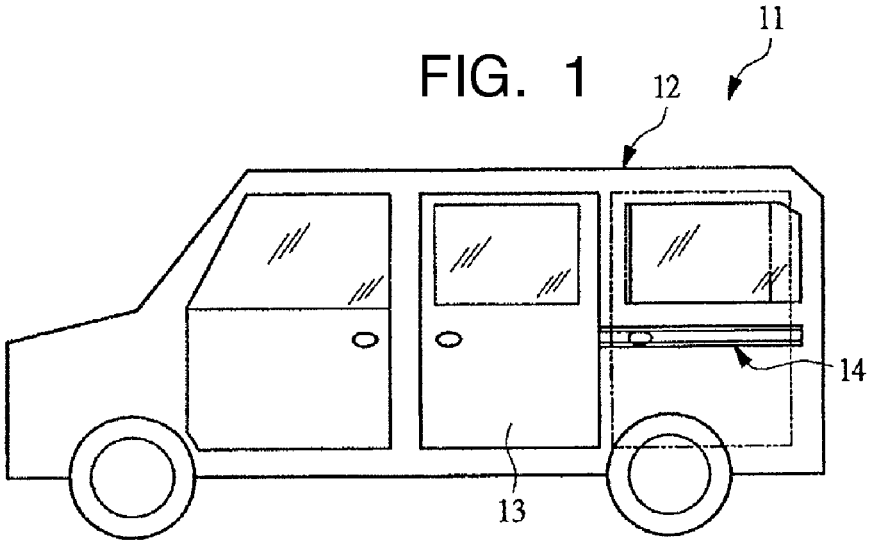
FIG. 1 is a side view showing a minivan-type vehicle.
Figure 2:
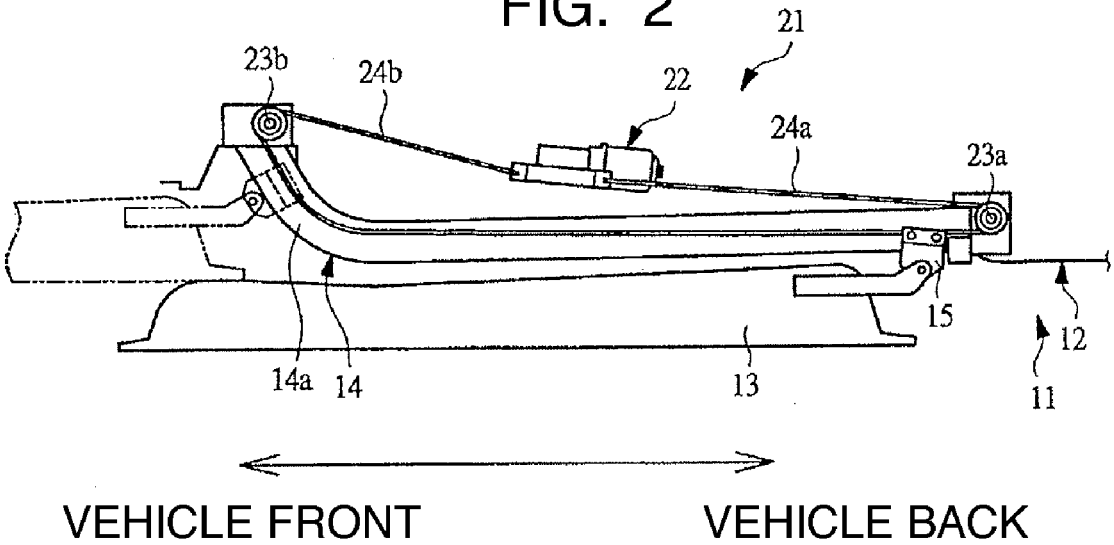
FIG. 2 is a top view showing a structure in which a sliding door depicted

FIG. 1 is a side view showing a minivan-type vehicle, and FIG. 2 is a top view showing a structure in which a sliding door depicted in FIG. 1 is attached to a vehicle body.

A side part of a vehicle body 12 of a minivan-type vehicle 11 depicted in FIG. 1 is provided with a sliding door 13 as an open/close member. The sliding door 13 is guided along a guide rail 14 fixed to the side part of the vehicle body 12 so as to be freely opened and closed between a full-close position represented by solid lines and a full-open position represented by two-dot chains in FIG. 1. When passengers and merchandise are loaded or unloaded, the sliding door 13 is opened up to a predetermined ratio of opening and then is used.

As depicted in FIG. 2, the sliding door 13 is provided with a roller assembly 15. When this roller assembly 15 is guided along the guide rail 14, the sliding door 13 becomes movable in front and back directions of the vehicle 11. Also, a vehicle-front side of the guide rail 14 is provided with a curve portion 14*a* curved toward a vehicle compartment. When the roller assembly 15 is guided along the curve portion 14*a*, the sliding door 13 is closed in a state of being drawn inside the vehicle body 12 so as to be accommodated in the same plane as a side surface of the vehicle body 12. Although not shown, the roller assembly 15 is also provided to a portion (center portion) shown in the drawings as well as vertical portions (upper and lower portions) of a front end of the sliding door 13, and, correspondingly to these, the vertical portions of an opening of the vehicle body 12 are also provided with guide rails (not shown) so as to correspond to the upper and lower positions. Thus, the sliding door 13 is supported at three positions in total in the vehicle body 12.

This vehicle 11 is provided with an automatic opening/closing apparatus for vehicle 21 (hereinafter "opening/closing apparatus 21") for automatically opening and closing the sliding door 13. This opening/closing apparatus 21 includes: a driving unit 22 disposed inside the vehicle body 12 so as to be adjacent to an approximately center portion of the guide rail 14 in vehicle-front and vehicle-back directions; an open-side cable 24*a* as a cable member connected from an open side (vehicle-back side) to the roller assembly 15 (sliding door 13) via a reverse pulley 23*a* provided at an end of the guide rail 14 on the vehicle-back side; and a close-side cable 24*b* as a cable member connected from a close side (vehicle-front side) to the roller assembly 15 (sliding door 13) via a reverse pulley 23*b* provided at an end of the guide rail 14 on the vehicle-front side. When the open-side cable 24*a* is drawn by the driving unit 22, the sliding door 13 is caused to perform automatically an open operation. When the close-side cable 24*b* is drawn by the driving unit 22, the sliding door 13 is caused to perform automatically a close operation.

Figure 3:
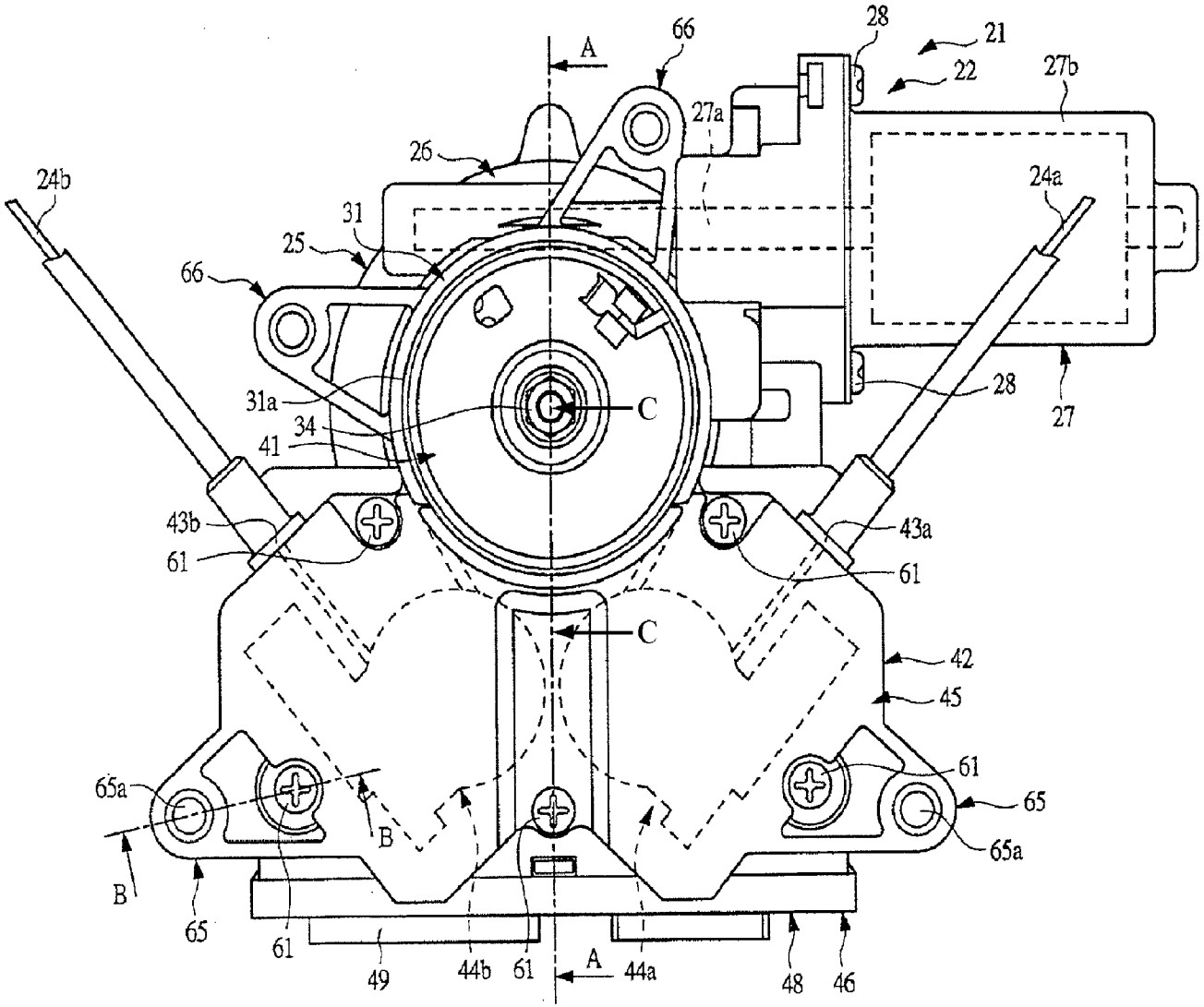
FIG. 3 is a front view showing a detail of a driving unit depicted in FIG. 2.
Figure 4:
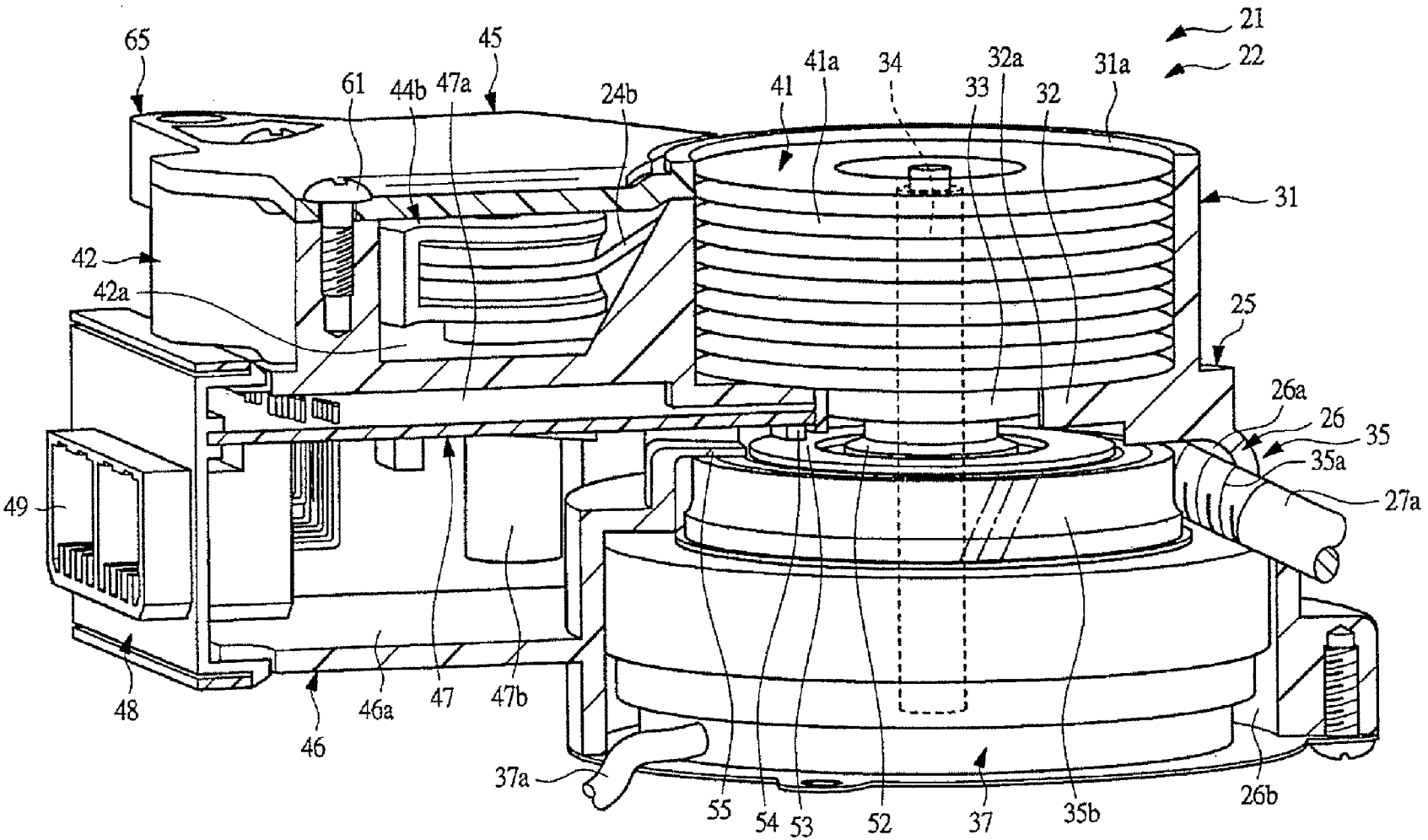
FIG. 4 is a sectional view taken along line A-A of FIG. 3.

FIG. 3 is a front view showing a detail of the driving unit depicted in FIG. 2, and FIG. 4 is a sectional view taken along line A-A in FIG. 3.

As depicted in FIGS. 3 and 4, the driving unit 22 is provided with a resin-made case 25 disposed in the vehicle body 12. This case 25 includes a reduction-mechanism housing portion 26 formed into an approximately cylindrical shape. Outside this reduction-mechanism housing portion 26, an electric motor 27 is attached as a driving source. The electric motor 27 is, for example, a brush-equipped direct-current motor, and its rotational shaft 27*a* is rotatable in both forward and backward directions, and a portion of its motor yoke 27*b* is fixed to the case 25 by bolts (fastening members) 28. As depicted in FIG. 4, a reduction-mechanism housing 26*a* is provided inside the reduction-mechanism housing portion 26, and the rotational shaft 27*a* of the electric motor 27 protrudes into this reduction-mechanism housing 26*a*.

The case 25 is provided with a drum housing portion 31 as an housing portion of a driving rotor integrally with the reduction-mechanism housing portion 26. The drum housing portion 31 is formed into such an approximately cylindrical shape as to be open on an opposite side to the reduction-mechanism housing portion 26, and its interior serves as a drum housing 31*a*. As depicted in FIG. 4, the drum housing 31*a* and the reduction-mechanism housing 26*a* are partitioned by a partition wall 32. A supporting hole 32*a* is formed in the partition wall 32, wherein a bearing 33 is mounted in the supporting hole 32*a* and a driving shaft 34 is rotatably supported in the case 25 by the bearing 33. One end of the driving shaft 34 protrudes into the reduction-mechanism housing 26*a* while the other end thereof protrudes into the drum housing 31*a*.

In order to decelerate rotation of the rotational shaft 27*a* up to the predetermined number of rotations and transmit it to the driving shaft 34, a reduction mechanism 35 is accommodated in the reduction-mechanism housing 26*a*. The reduction mechanism 35 serves as a worm-gear mechanism including a worm 35*a* and a worm wheel 35*b* as a rotor. The worm 35*a* is formed integrally with the rotational shaft 27*a* on an outer circumferential surface of the rotational shaft 27*a*, and the worm wheel 35*b* is relatively rotatably supported by the driving shaft 34, thereby being rotatable inside the case 25.

Also, as depicted in FIG. 4, the reduction-mechanism housing portion 26 of the case 25 is provided with a clutch housing 26*b* integrally with the reduction-mechanism housing 26*a*. An electromagnetic clutch 37 as a motive-power intermissive mechanism is accommodated in this clutch housing 26*b* in order to intermit motive-power transmission between the worm wheel 35*b* and the driving shaft 34, that is, between the electric motor 27 and the driving shaft 34. This electromagnetic clutch 37 is a so-called friction type, and becomes in a connection state when a current is carried via a connection wiring 37*a*, thereby allowing the motive-power transmission between the worm wheel 35*b* and the driving shaft 34. Therefore, when the electric motor 27 is operated after the electromagnetic clutch 37 has been in a current-carried state, the rotation of the rotational shaft 27*a* is transmitted to the driving shaft 34 via the reduction mechanism 35 and the electromagnetic clutch 37, thereby causing the driving shaft 34 to rotate along with the worm wheel 35*b*. Meanwhile, when the current stops, the electromagnetic clutch 37 becomes in an intermissive state, thereby intermitting a motive-power transmission path between the worm wheel 35*b* and the driving shaft 34.

As depicted in FIGS. 3 and 4, a driving drum 41 as a driving rotor is accommodated in the drum housing 31*a*. The driving drum 41 is made of a resin, wherein its axial center is fixed to a tip of the driving shaft 34 so that the driving drum 41 can be rotated inside the case 25. A spiral guide groove 41*a* is formed in an outer circumferential surface of the driving drum 41. The open-side cable 24*a* guided by the driving unit 22 is wound around the driving drum 41 along the guide groove 41*a*, and simultaneously its end is fixed to the driving drum 41. Similarly, the close-side cable 24*b* guided by the driving unit 22 is wound around the driving drum 41 along the guide groove 41*a* in the same direction as that of the open-side cable 24*a*, and its end is fixed to the driving drum 41. That is, one end side of each of the cables 24*a* and 24*b* is wound around the driving drum 41 and the other end side thereof is connected to the sliding door 13. When the electric motor 27 is activated, its rotation is transmitted via the reduction mechanism 35 and the electromagnetic clutch 37 to the driving shaft 34 and the driving drum 41 is driven and rotated by the electric motor 27 for rotation along with the driving shaft 34. When the driving drum 41 is rotated, either one of the cables 24*a* and 24*b* is reeled by the driving drum 41 according to a rotating direction of the driving drum 41, thereby causing the sliding door 13 to be drawn by the relevant one of the cables 24*a* and 24*b* and to carry out open or close movement.

The case 25 is provided with a tensioner housing portion 42 integrally with the drum housing portion 31 and the reduction-mechanism housing portion 26 and adjacently to the drum housing portion 31. The tensioner housing portion 42 is formed into such a bathtub shape as to be open in the same direction as that of the drum housing portion 31 and, as depicted in FIG. 4, its interior serves as a tensioner housing 42*a*. The tensioner housing portion 42 is provided with a pair of cable incoming/outgoing portions 43*a* and 43*b* for drawing the cables 24*a* and 24*b* into the tensioner housing 42*a*, respectively. The open-side cable 24*a* and the close-side cable 24*b* are drawn respectively from the corresponding cable incoming/outgoing portions 43*a* and 43*b* into the tensioner housing 42*a*, thereby being guided via the tensioner housing 42*a* into the drum housing 31*a*. As depicted by broken lines in FIG. 3, a pair of tensioner mechanisms 44*a* and 44*b* as necessary appliances is accommodated in the tensioner housing 42*a*, and a predetermined tension is applied to each of the cables 24*a* and 24*b* by these tensioner mechanisms 44*a* and 44*b*. For this reason, even when the roller assembly 15 is guided to the curve portion 14*a* of the guide rail 14 and length of movement paths of the cables 24*a* and 24*b* is changed between the sliding door 13 and the driving drum 41, the tension of each of the cables 24*a* and 24*b* can be kept constant. Also, a cover 45 is attached to the tensioner housing portion 42, whereby this cover 45 causes the tensioner housing 42*a* to be blocked so that the tensioner mechanisms 44*a* and 44*b* is covered with the cover 45.

Incidentally, a description will be later made of detailed structures of the tensioner mechanisms 44*a* and 44*b*.

In the case 25, a substrate housing portion 46 is provided integrally with the reduction-mechanism housing portion 26, the drum housing portion 31, and the tensioner housing portion 42. This substrate housing portion 46 is located on a back side of the tensioner housing portion 42, and is formed into such a box shape as to have an opening in a direction shifted by 90 degrees with respect to the openings of the reduction-mechanism housing 26*a* and the clutch housing 26*b* and its interior serves as a substrate housing 46*a*. In the substrate housing 46*a*, a control substrate 47 as a necessary appliance is accommodated for controlling operations of the electric motor 27 and the electromagnetic clutch 37. The control substrate 47 has a structure in which a control circuit equipped with an electronic component 47*b* such as a CPU or memory is mounted on a substrate main body 47*a* made of a resin, thereby being connected to the electric motor 27 by a connection terminal etc. (not shown) wired inside the case 25. Also, the substrate housing 46*a* is enclosed by a substrate cover 48. This substrate cover 48 is provided with a connector 49 connected to the control substrate 47. The control substrate 47 is connected via this connector 49 to a power supply (not shown) such as a battery mounted on the vehicle 11 and to an open/close switch etc. disposed inside the vehicle compartment.

Here, in this opening/closing apparatus 21, the drum housing portion 31 that accommodates the driving drum 41 and the substrate housing portion 46 that accommodates the control substrate 47 are formed integrally with the same case 25, and it is not required to provide a case that accommodates the control substrate 47 separately from the case 25 that accommodates the driving drum 41. Therefore, the number of components of the opening/closing apparatus 21 is reduced and accordingly its cost can be reduced.

In this manner, in the opening/closing apparatus 21, since the driving drum 41 and the control substrate 47 are accommodated in the same case 25, it is unnecessary to provide a case for accommodating the control substrate 47 separately from the case 25 that accommodates the driving drum 41, whereby the cost of the opening/closing apparatus 21 can be reduced. Also, it is unnecessary to provide separately a case for accommodating the control substrate 47, so that the driving drum 41 and the control substrate 47 can be efficiently disposed in the same case 25, whereby the opening/closing apparatus 21 can be downsized. Furthermore, since the control substrate 47 and the electric motor 27 can be connected inside the case 25, an external harness etc. for connecting the electric motor 27 and the control substrate 47 is not required, whereby the cost of the opening/closing apparatus 21 can be reduced.

Also, in the opening/closing apparatus 21, the tensioner housing portion 42 that accommodates the tensioner mechanisms 44*a* and 44*b* is also provided integrally with the case 25. Therefore, even when the tensioner mechanisms 44*a* and 44*b* are intended to be provided, providing a new case for accommodating these mechanisms becomes unnecessary, the cost of the opening/closing apparatus 21 is reduced, and it can be downsized.

Furthermore, in the opening/closing apparatus 21, the reduction-mechanism housing portion 26 that accommodates the reduction mechanism 35 for decelerating the rotation of the electric motor 27 to transmit it to the driving drum 41 is also provided integrally with the case 25. Therefore, providing separately another case for accommodating the reduction mechanism 35 becomes unnecessary, the cost of the opening/closing apparatus 21 is further reduced, and it can be also downsized.

Still further, in the opening/closing apparatus 21, the clutch housing 26*b* for accommodating the electromagnetic clutch 37 that intermits motive-power transmission between the worm wheel 35*b* and the driving shaft 34 is provided in the case 25. Therefore, providing separately a case that accommodates the electromagnetic clutch 37 becomes unnecessary, the cost of the opening/closing apparatus 21 is further reduced, and it can be also downsized.

Figure 5:
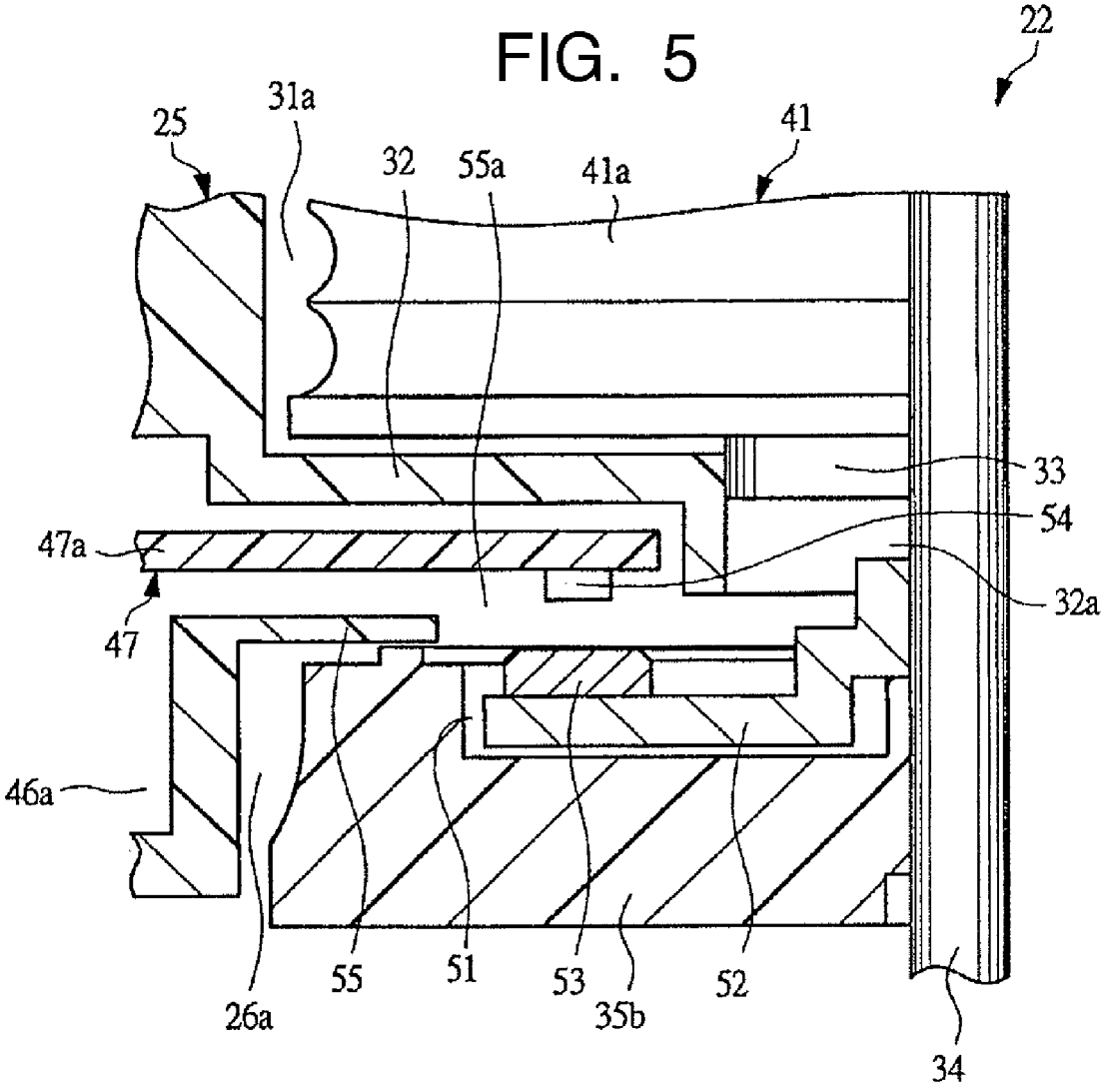
FIG. 5 is a sectional view showing a detail of a rotation sensor and a multi-polar magnetized magnet, taken along line C-C of FIG. 3.

FIG. 5 is a sectional view showing a detail of a rotation sensor and a multi-polar magnetized magnet.

As depicted in FIG. 5, a circular concave portion 51 is formed at an axial-directional end portion of the worm wheel 35*b* located on an opposite side to the driving drum 41. A rotating plate 52 formed into a disk shape is fixed to the driving shaft 34 so as to be positioned inside the concave portion 51. A multi-polar magnetized magnet 53 as a detected subject is fixed to the rotating plate 52, and the multi-polar magnetized magnet 53 is provided with many magnetic poles aligned in a circumferential direction. In this manner, the multi-polar magnetized magnet 53 is fixed to the driving shaft 34 via the rotating plate 52, and the multi-polar magnetized magnet 53 is rotated between the driving drum 41 and the worm wheel 35*b* together with the driving shaft 34 concentrically with the driving shaft 34.

On the other hand, a part of the substrate housing 46*a* protrudes into a gap between the driving drum 41 and the worm wheel 35*b*, and a part of the substrate main body 47*a* of the control substrate 47 is disposed between the driving drum 41 and the worm wheel 35*b*. In a part of the substrate main body 47*a* disposed between the driving drum 41 and the worm wheel 35*b*, a rotation sensor 54 for detecting the rotation of the driving shaft 34 is mounted. The rotation sensor 54 is a Hall IC, which opposes to the multi-polar magnetized magnet 53 via a window 55*a* provided to a partition wall 55 partitioning the substrate housing 46*a* and the reduction-mechanism housing 26*a*. For this reason, when the electric motor 27 is activated to rotate the driving shaft 34, a pulse signal with a cycle depending on the rotation of the driving shaft 34, that is, the multi-polar magnetized magnet 53 is outputted from the rotation sensor 54. The rotation sensor 54 is connected to a control circuit implemented on the substrate main body 47*a*, and the pulse signal outputted from the rotation sensor 54 is inputted to the control circuit. The control substrate 47 recognizes rotation speed of the driving shaft 34 based on the cycle of the pulse signal, and counts the pulse signal, thereby recognizing an amount of rotation of the driving shaft 34, that is, the door position of the sliding door 13. Based on such recognition information, the control substrate 47 then controls the operation of the electric motor 27.

In this manner, in the opening/closing apparatus 21, the part of the control substrate 47 is disposed between the driving drum 41 and the worm wheel 35*b*, and the rotation sensor 54 is mounted on the part, so that the substrate for the rotation sensor 54 is not required to be provided separately from the control substrate 47. Therefore, the number of components forming the substrate for providing the rotation sensor 54 is reduced, whereby the cost of the opening/closing apparatus 21 can be reduced.

Incidentally, in the present embodiment, the rotation sensor 54 is intended to oppose to the multi-polar magnetized magnet 53 via the window 55*a* provided on the partition wall 55. However, the present invention is not limited to this embodiment, and may have a structure of opposing the rotation sensor 54 to the multi-polar magnetized magnet 53 via the partition wall 55 without providing the window 55*a* to the partition wall 55.

Figure 6:
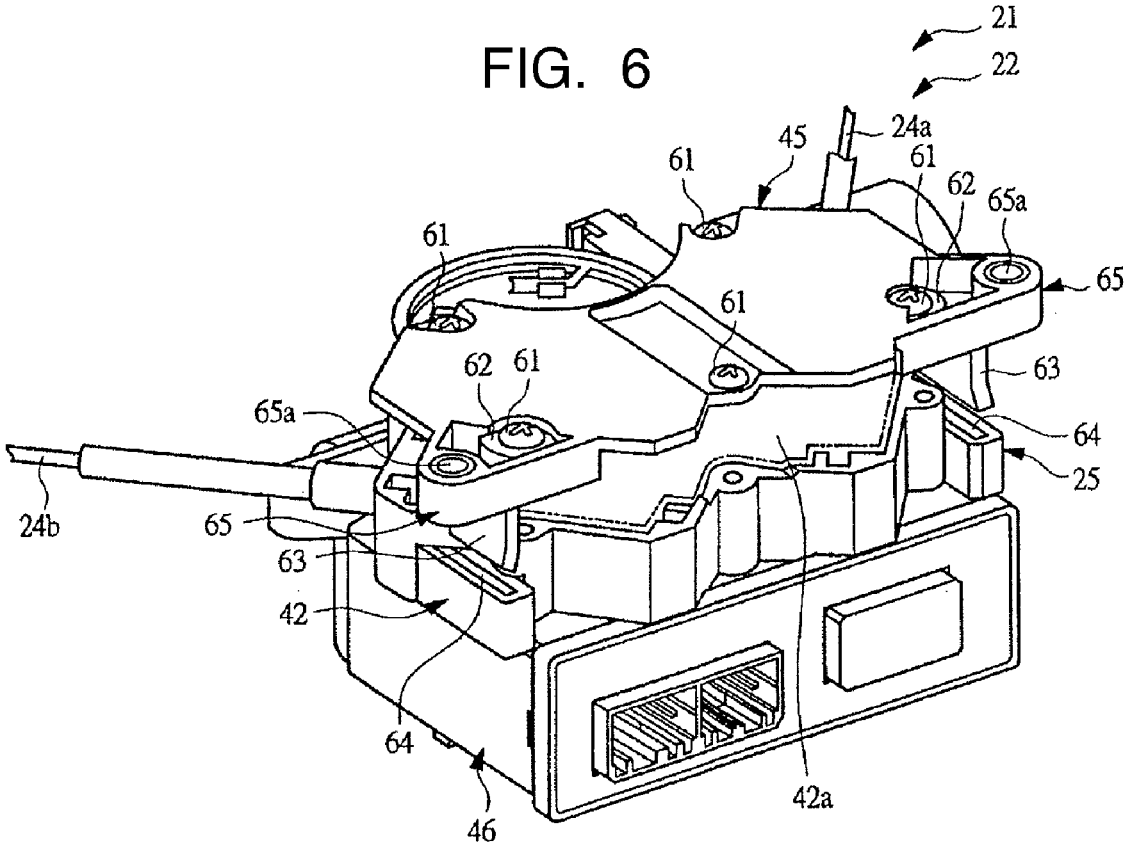
FIG. 6 is an exploded perspective view showing a case and a cover depicted in FIG. 3.
Figure 7:
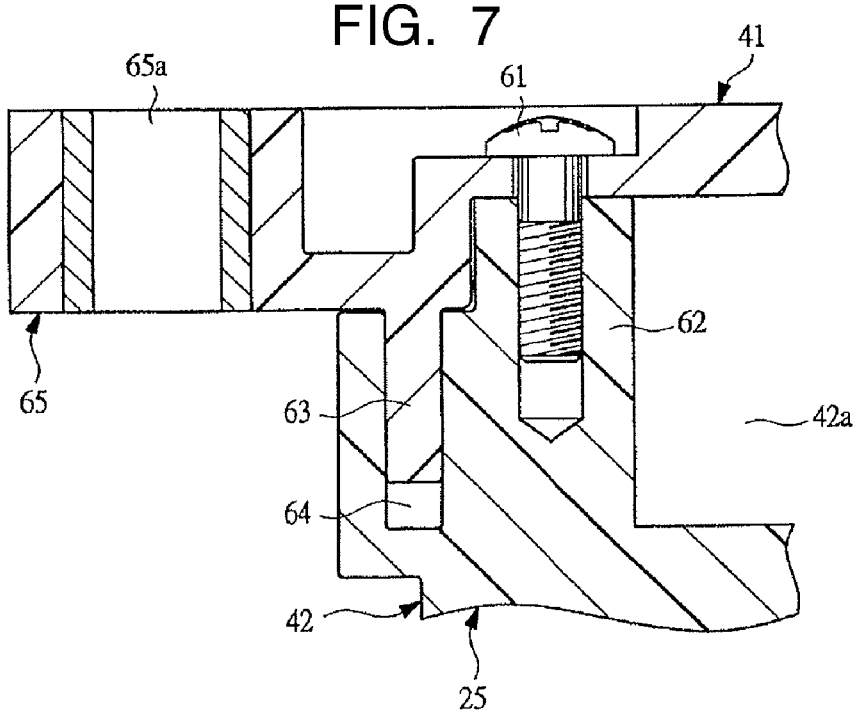
FIG. 7 is a sectional view taken along line B-B of FIG. 3.

FIG. 6 is an exploded perspective view of the case and the cover depicted in FIG. 3, and FIG. 7 is a sectional view taken along line B-B depicted in FIG. 3.

To the tensioner housing portion 42 of the case 25, the cover 45 for enclosing the tensioner housing 42*a* is attached. This cover 45 is formed into a plate shape and made of a resin, and is fixed to the tensioner housing portion 42 by five screw members 61. With this cover 45, the tensioner mechanisms 44*a* and 44*b* are covered.

A pair of engaging legs 63 as engaging portions is provided integrally with the cover 45 so as to be adjacent to respective screw insertion portions 62 into which the screw members 61 are inserted. On the other hand, a pair of engaging grooves 64 corresponding to the respective engaging legs 63 is formed in the case 25. The engaging legs 63 are each formed into a plate-piece shape and protrude toward the case 25. The engaging grooves 64 are each formed into a groove shape slightly larger in width than the engaging leg 63. When the cover 45 is attached to the case 25, as depicted in FIG. 7, each of the engaging legs 63 is inserted into the relevant engaging groove 64, thereby being engaged with the engaging groove 64 in a manner of concave-convex engagement. For this reason, when the cover 45 is fixed to the case 25 by the screw members 61 screwed into the screw insertion portion, the cover 45 is reliably engaged with the case 25 by the engaging legs 63, whereby a fixing strength of the cover 45 to the case 25 is increased.

The cover 45 is provided with a pair of attaching legs 65 as fixing portions for fixing the driving unit 22 to the vehicle body 12. Each of these attaching legs 65 is adjacent to the relevant engaging leg 63, is disposed so as to be aligned with the screw insertion portion 62 across the engaging leg 63, and is formed so as to have high stiffness with respect to the cover 45 and the case 25 to which the cover 45 is fixed. Also, each attaching leg 65 is provided with a bolt insertion hole 65*a* into which a bolt for fixing (not shown) is inserted. To prevent an axial direction of each of these bolt insertion holes 65*a* from overlapping the case 25, the attaching leg 65 is formed so as to protrude in a width direction with respect to the case 25. These attaching legs 65 are directly fixed to a panel of the vehicle body 12 by bolts (not shown) that are inserted into the bolt insertion holes 65*a* without interposing brackets etc. For this reason, the driving unit 22 is fixed to the vehicle body 12 by the attaching legs 65. Incidentally, in the present embodiment, the reduction-mechanism housing portion 26 is also provided with a pair of attaching legs 66, and the driving unit 22 is fixed to the panel of the vehicle body 12 by the four attaching legs 65 and 66 in total.

In this manner, in the opening/closing apparatus 21, the attaching legs 65 fixed to the vehicle body 12 are provided to the cover 45 that encloses the tensioner housing portion 42 provided to the case 25, so that the case 25, that is, the driving unit 22 can be fixed to the vehicle body 12 without using other members such as brackets. Therefore, the number of components of the opening/closing apparatus 21 is reduced, and its cost can be reduced. Also, when the driving unit 22 is shared with a plurality of vehicle types, such shared use can be achieved by replacing only the cover 45 depending on the vehicle type without preparing a bracket etc. depending on the vehicle type. Therefore, even when the driving unit 22 is shared with other vehicle types, its cost can be reduced.

Furthermore, in the opening/closing apparatus 21, since the engaging legs 63 that are engaged with the case 25 in a manner of the convex-concave engagement are provided to the cover 45 so as to be adjacent to the attaching legs 65, loads exerted on the attaching legs 65 can be reliably supported by the case 25 via the engaging legs 63. For this reason, the fixing strength of the driving unit 22 to the vehicle body 12 can be increased by the attaching legs 65.

Incidentally, in the present embodiment, the cover 45 that encloses the tensioner housing 42*a* is intended to be provided with the attaching legs 65 as the fixing portions. However, the present invention is not limited to the embodiment and, for example, so long as there is a cover, which encloses the case 25 and with which a necessary appliance is covered, such as the substrate cover 48 that is attached to the substrate housing portion 46 accommodating the control substrate 47 and covers the control substrate 47 or a cover that is attached to the drum housing portion 31 accommodating the driving drum 41 and covers the driving drum 41, the attaching legs 65 as the fixing portions may be provided to the above cover.

Also, in the present embodiment, the cover 45 is provided with the engaging legs 63 each formed into a plate-piece shape, and the engaging grooves 64 are formed in the case 25. However, the present invention is not limited to the embodiment and, for example, so long as there is a structure, in which the cover 45 is engaged with the case 25 in a manner of the concave-concave engagement, such as a structure in which the case 25 is provided with the engaging legs 63 and the cover 45 is provided with the engaging grooves 64, the present invention may adopt the above structure.

Figure 8:
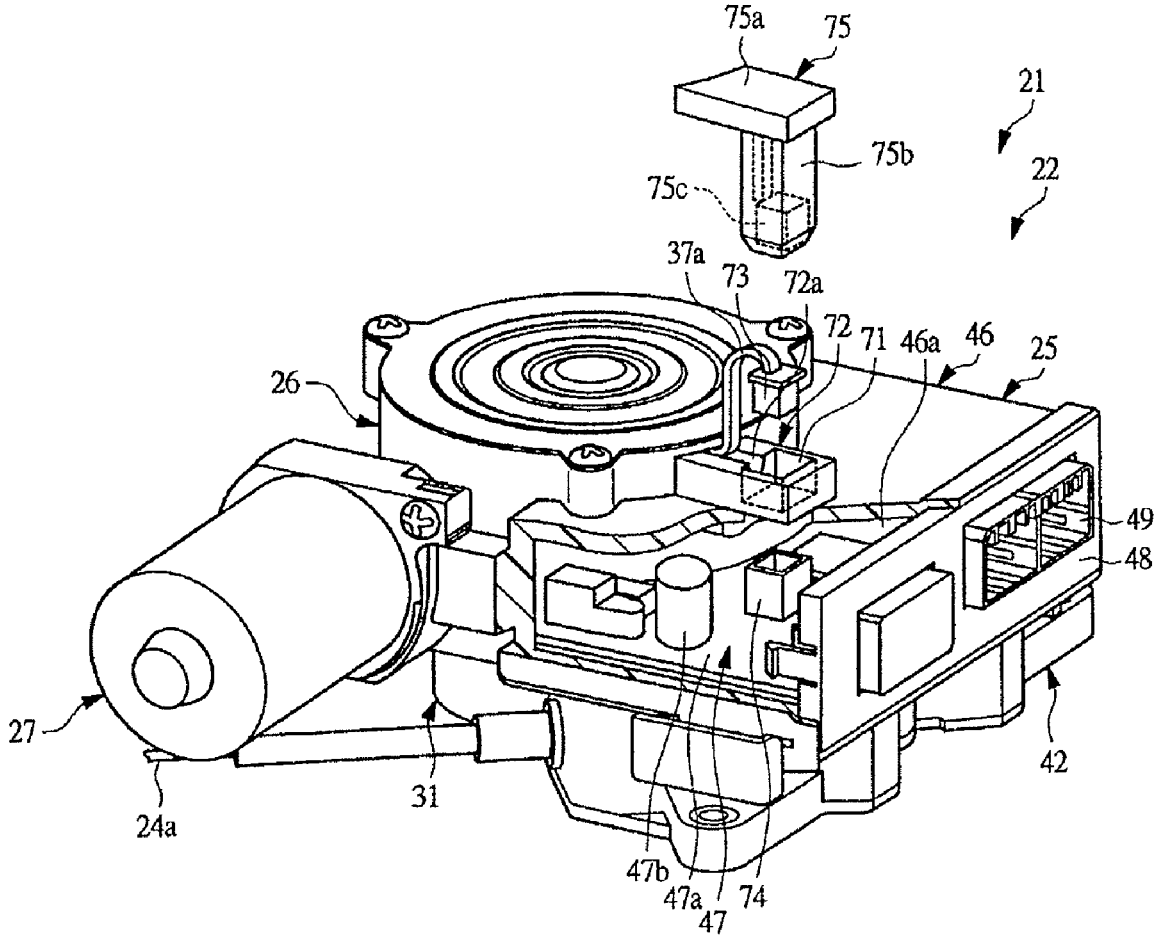
FIG. 8 is a partially-broken sectional view showing the driving unit depicted in FIG. 3.
Figure 9:
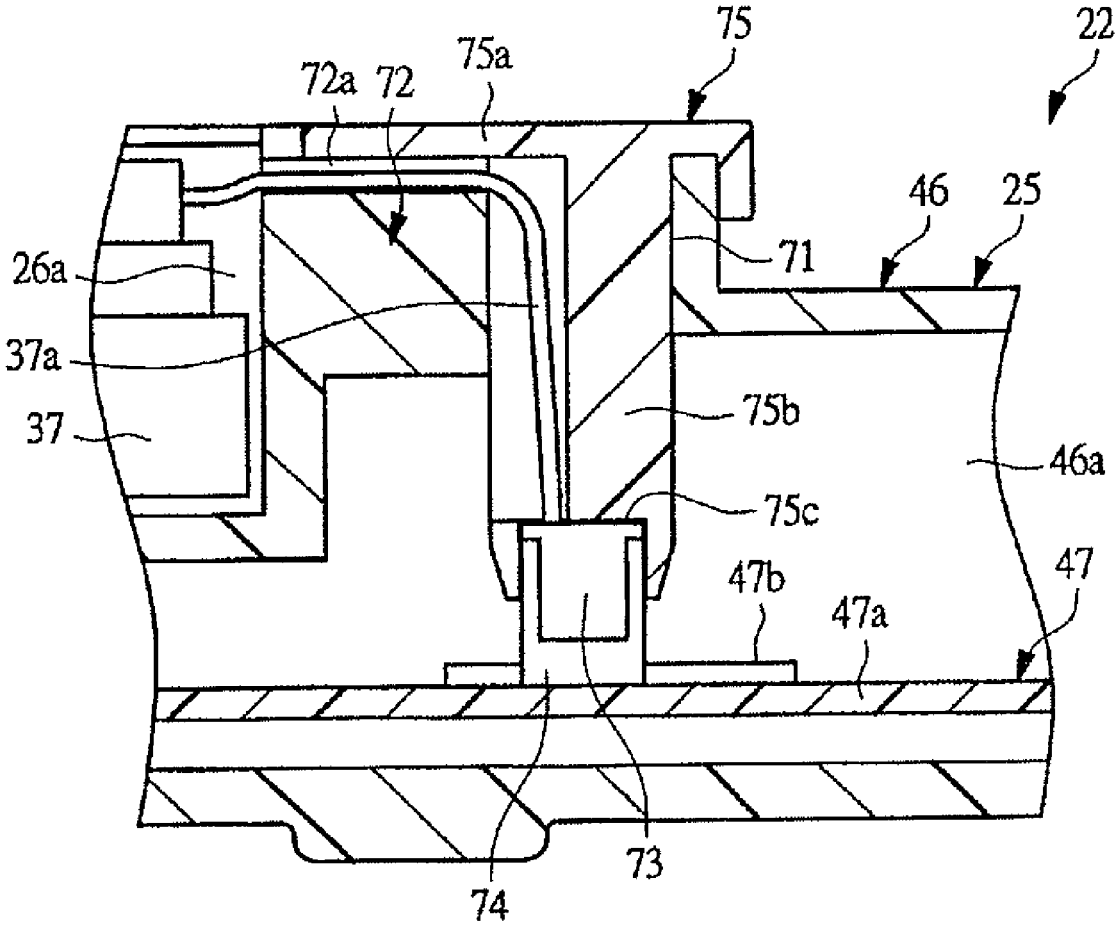
FIG. 9 is a sectional view showing a connection structure between a connector of an electromagnetic clutch and a control substrate, taken along line B-B of FIG. 10.

FIG. 8 is a partially-broken sectional view of the driving unit depicted in FIG. 3, and FIG. 9 is a sectional view showing a connection structure between a connector of the electromagnetic clutch and the control substrate.

As depicted in FIGS. 8 and 9, in order that a connection wiring 37*a* provided to the electromagnetic clutch 37 is connected to the control substrate 47, a wiring lead hole 71 is formed in the case 25. An outer surface of the substrate housing portion 46 in the case 25 is provided with a guide block 72 adjacently to the clutch housing 26*b*. The wiring lead hole 71 is formed in the guide block 72 so as to be adjacent to an opening of the clutch housing 26*b* and to be open toward the same direction as that of the clutch housing 26*b*. By this wiring lead hole 71, the substrate housing 46*a* communicates with an interior and an exterior of the case 25.

The connection wiring 37*a* of the electromagnetic clutch 37 is drawn outside the case 25 from the opening of the clutch housing 26*b*, and is laid down along a guide groove 72*a* formed in the guide block 72, thereby being drawn inside the substrate housing 46*a* from the wiring lead hole 71. Also, a tip of the connection wiring 37*a* is provided with a convex type connector 73. By engaging this connector 73 with a concave type connector 74 provided to the control substrate 47, the connection wiring 37*a*, that is, the electromagnetic clutch 37 is intended to be connected to the control substrate 47.

A holder 75 for facilitating the connection between the connection wiring 37*a* and the control substrate 47 is removably mounted on the wiring lead hole 71. This holder 75 is made of a resin, and has a cover plate 75*a* disposed on the guide block 72 to cover the guide groove 72*a* and the wiring lead hole 71, and a holding portion 75*b* formed into a rectangular parallelepiped shape and protruding predetermined length from the cover plate 75*a* toward the interior of the substrate housing 46*a*. A tip of the holding portion 75*b* is provided with a holding hole 75*c*. The connector 73 of the connection wiring 37*a* is held by the holder 75 as being inserted into the holding hole 75*c*. By mounting the holder 75 on the case 25 so that the holding portion 75*b* in a state of holding the connector 73 is inserted into the wiring lead hole 71, as depicted in FIG. 9, the connector 73 of the connection wiring 37*a* is intended to be connected to the connector 74 of the control substrate 47. At this time, the holder 75 is guided along the guide block 72 to move toward the connector 74 of the control substrate 47, so that even when each of the connectors 73 and 74 cannot be viewed, each of the connectors 73 and 74 can be reliably engaged by mounting the holder 75 on the case 25.

In this manner, in the opening/closing apparatus 21, the connection wiring 37*a* of the electromagnetic clutch 37 is drawn out (derived) from the clutch housing 26*b* and is also drawn in the substrate housing 46*a* via the wiring lead hole 71 provided to the case 25 so as to be connected to the control substrate 47. Therefore, even when the case 25 is such that the clutch housing 26*b* and the substrate housing 46*a* are disposed for their openings as to be oriented in different directions, the connection wiring 37*a* of the electromagnetic clutch 37 can be easily connected to the control substrate 47.

Also, in the opening/closing apparatus 21, the connector 73 provided to the connection wiring 37*a* is held by the holder 75, and this holder 75 is mounted on the wiring lead hole 71 provided to the case 25, thereby engaging the connector 73 with the connector 74 of the control substrate 47. Therefore, a connecting operation of the connection wiring 37*a* to the control substrate 47 can be further facilitated.

Furthermore, in the opening/closing apparatus 21, the connection wiring 37*a* is drawn in the substrate housing 46*a* from the wiring lead hole 71, and a space between the substrate housing 46*a* and the clutch housing 26*b* is covered with the cover plate 75*a* of the holder 75. Therefore, the connection wiring 37*a* is not exposed to the outside, thereby making it possible to prevent the connection wiring 37*a* from interfering with other components.

Incidentally, since the holder 75 is fixed to the case 25 by, for example, being pressed into the case 25 or engaging its claw with the case 25, the holder 75 is prevented from being released from the case 25.

Figure 10:
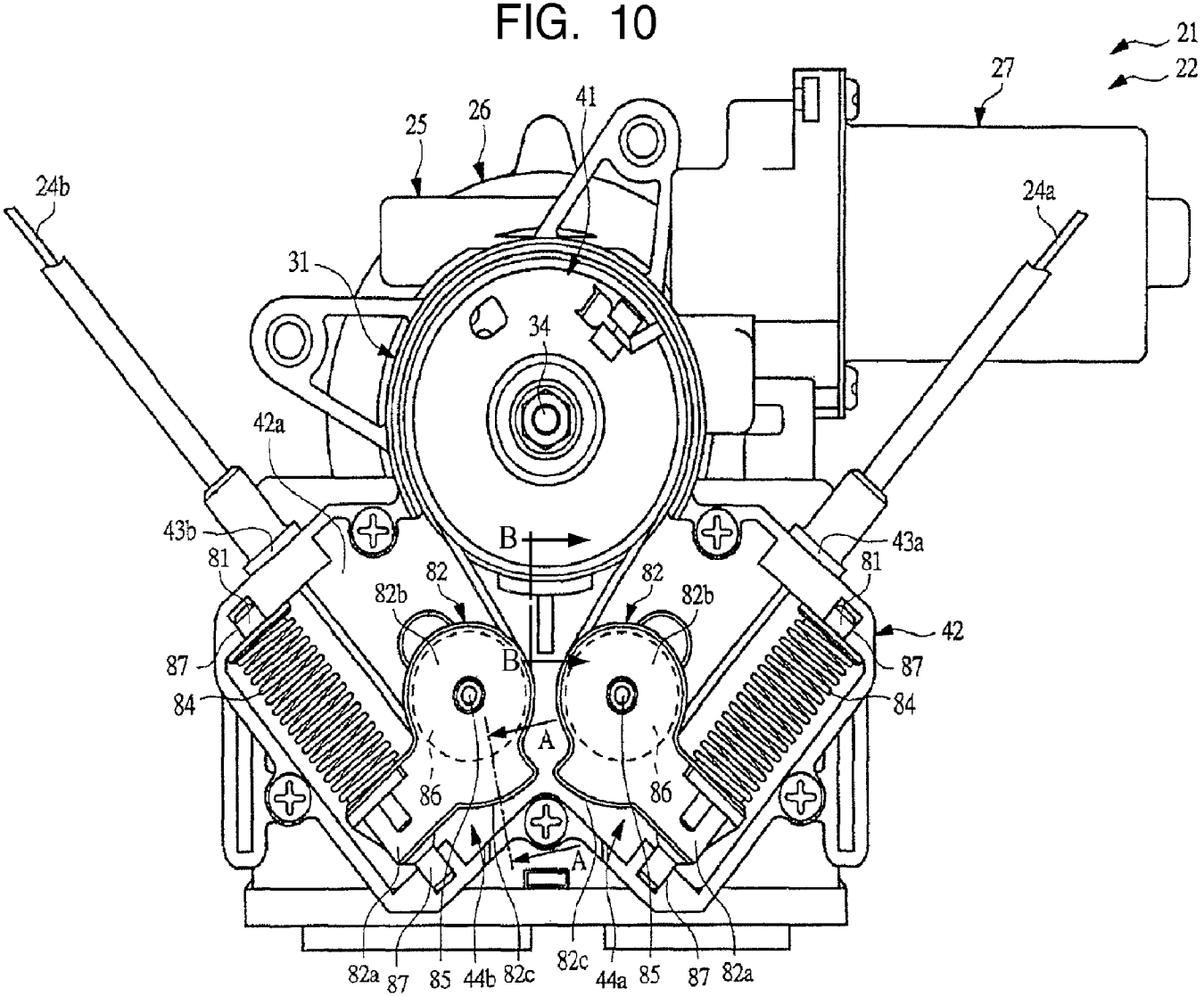
FIG. 10 is a front view showing a detail of a tensioner mechanism.
Figure 11:
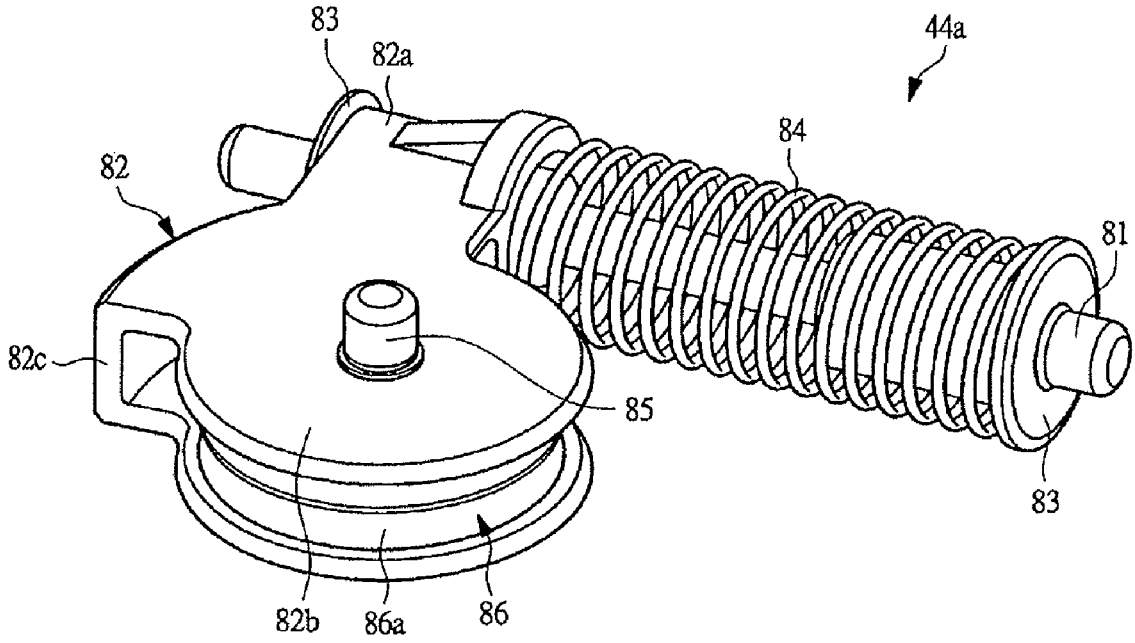
FIG. 11 is a perspective view showing the detail of the tensioner mechanism depicted in FIG. 10.
Figure 12:
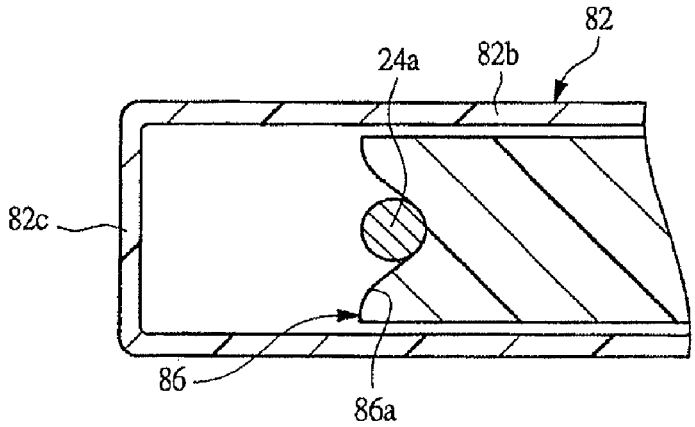
FIG. 12 is a sectional view taken along line A-A of FIG. 10.
Figure 13:
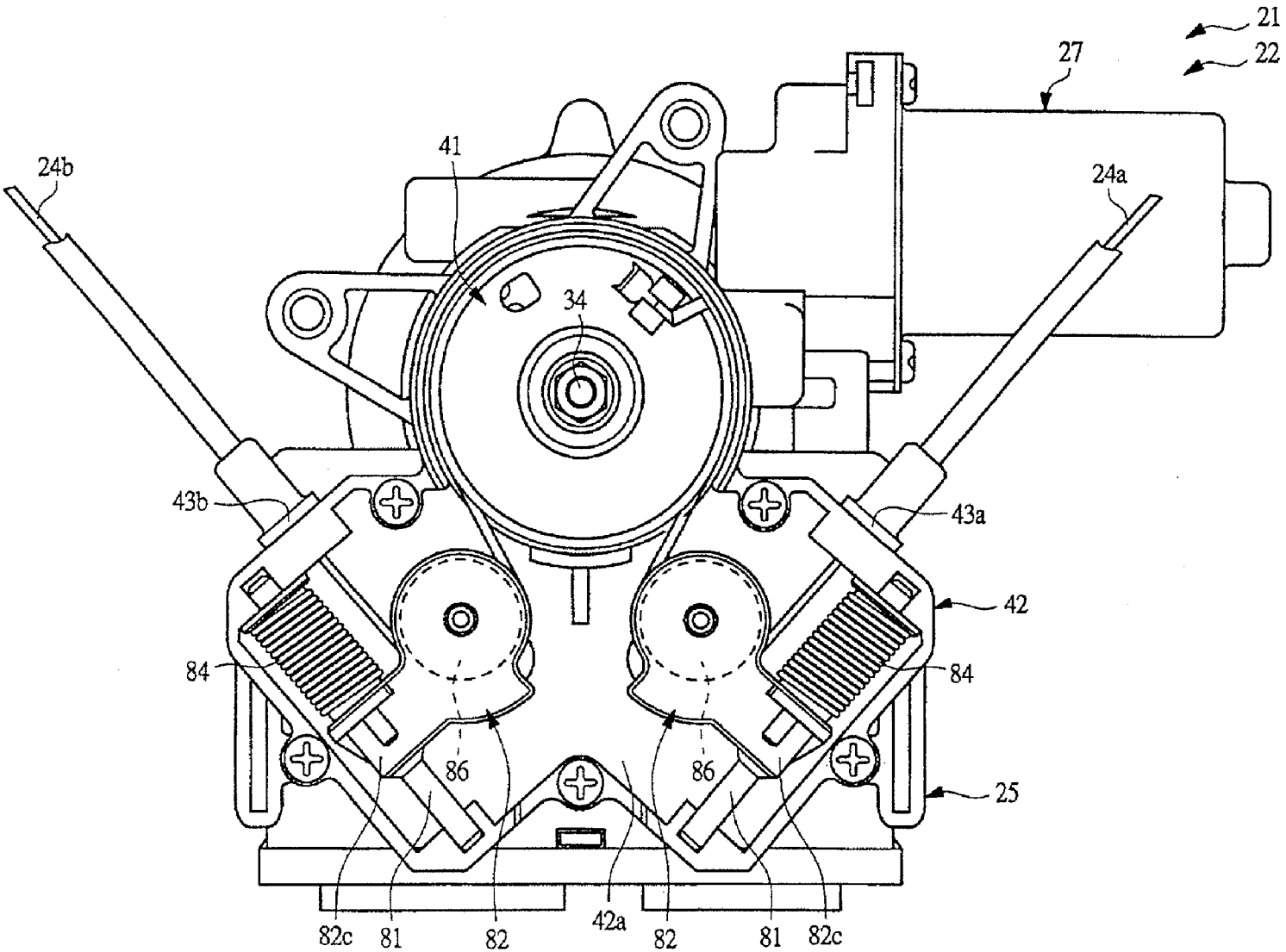
FIG. 13 is a front view showing an operating state of the tensioner mechanism depicted in FIG. 10.
Figure 14:
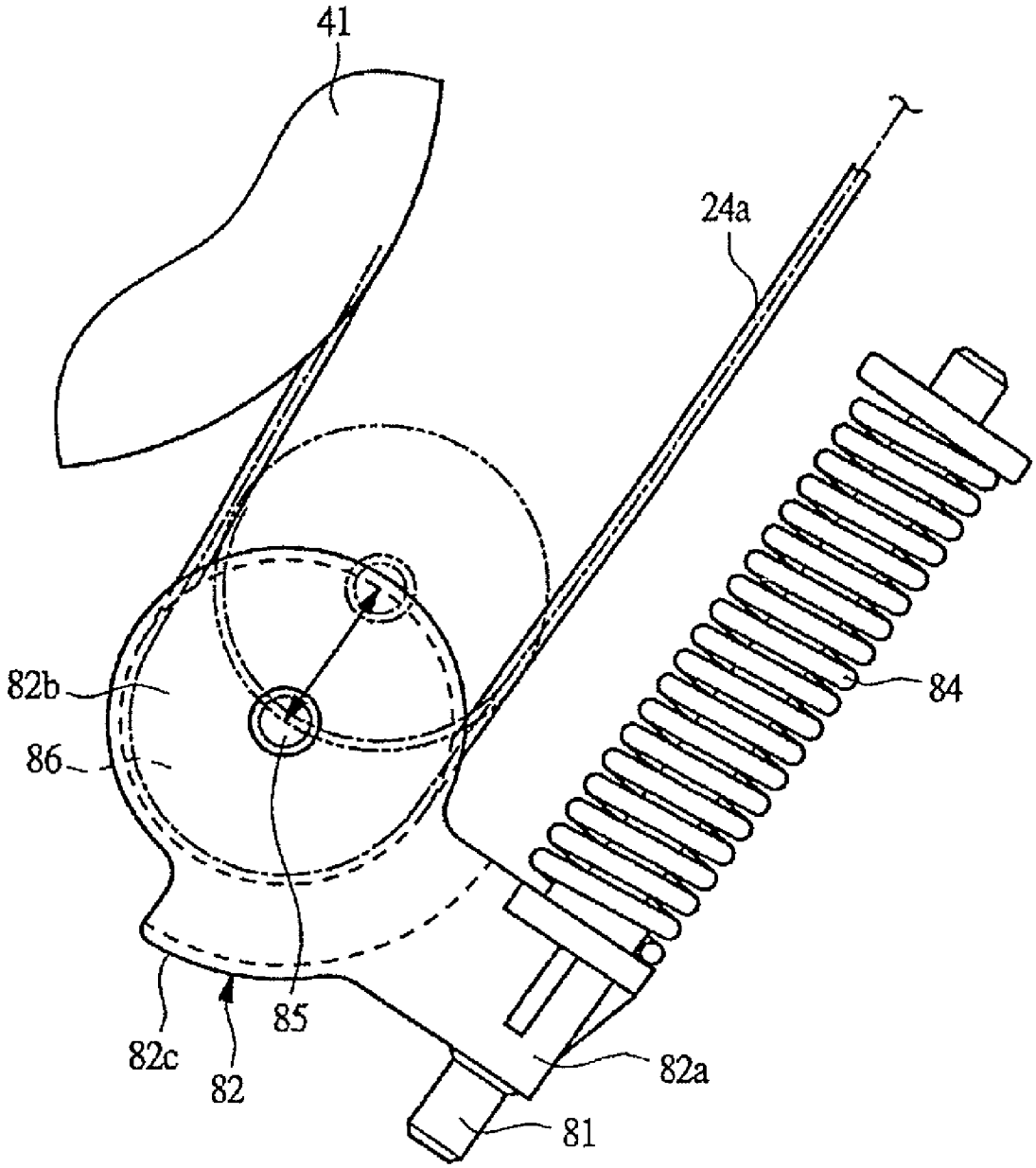
FIG. 14 is an explanatory view showing a cable state when the tensioner mechanism is operated.

FIG. 10 is a front view showing a detail of a tensioner mechanism; FIG. 11 is a perspective view showing the detail of the tensioner mechanism depicted in FIG. 10; and FIG. 12 is a sectional view taken along line A-A of FIG. 10. FIG. 13 is a front view showing an operating state of the tensioner mechanism depicted in FIG. 10 is operated; and FIG. 14 is an explanatory view showing a cable state when the tensioner mechanism is operated.

As shown in FIG. 10, the driving unit 22 includes an open-side tensioner mechanism 44*a* for applying a predetermined tension to the open-side cable 24*a* and a close-side tensioner mechanism 44*b* for applying a predetermined tension to the close-side cable 24*b*. The tensioner mechanisms 44*a* and 44*b* are symmetrically distributed on one side and the other side with respect to a line segment passing through a shaft center of the driving drum 41, and are disposed in the tensioner housing 42*a* so as to be adjacent to each other.

The tensioner mechanisms 44*a* and 44*b* will be described below in detail. However, since the open-side tensioner mechanism 44*a* basically has the same structure as that of the close-side tensioner mechanism 44*b*, the open-side tensioner mechanism 44*a* will mainly be described below.

As shown in FIG. 11, the open-side tensioner mechanism 44*a* (hereinafter abbreviated as "tensioner mechanism 44*a*") includes a guide shaft 81, and a pulley holder 82 is mounted on the guide shaft 81. The pulley holder 82 includes a slide portion 82*a* and a main body portion 82*b* which is provided integrally with the slide portion 82*a*. The slide portion 82*a* is mounted on the guide shaft 81, thereby being intended to be movable along the guide shaft 81. Stoppers 83 are provided on both end sides of the guide shaft 81, and a movement range of the slide portion 82*a* is restricted between the stoppers 83. A spring 84 as a spring member is mounted on the guide shaft 81 so as to be located between one of the stoppers 83 and the slide portion 82*a*, and the slide portion 82*a* is biased toward the other of the stoppers 83 by the spring 84.

On the other hand, a movable pulley 86 is rotatably supported in the main body portion 82*b* by a supporting shaft 85. The movable pulley 86 is formed smaller in diameter than the driving drum 41, and its outer circumference is provided with a groove 86*a* having a V-shape cross-section so as to be engaged with the cable 24*a*. In order to prevent the cable 24*a* from being released from the movable pulley 86, the main body portion 82*b* is provided with a guide wall 82*c* integrally with the main body portion 82*b*. The guide wall 82*c* is formed into such an arc shape as to oppose to an outer circumferential surface of the movable pulley 86 and to have a predetermined space (interval), thereby being formed within a range of about 90 degrees along the outer circumferential surface of the movable pulley 86 including a portion overlapping the slide portion 82*a*. For this reason, as shown in FIG. 12, the cable 24*a* wound around the movable pulley 86 is disposed between the movable pulley 86 and the guide wall 82*c*. Therefore, even if the tension is excessively loosened and the cable 24*a* is released from the movable pulley 86, the cable 24*a* is retained between the movable pulley 86 and the guide wall 82*c* and when the tension is recovered so as to fall within the proper range, the cable 24*a* is naturally engaged with the movable pulley 86.

The guide shaft 81, the pulley holder 82, and the spring 84 and the like are previously assembled in the tensioner mechanism 44*a* to form one unit as shown in FIG. 11, and the tensioner mechanism 44*a* is assembled to the case 25 while being unitized. The tensioner housing portion 42 is provided with mounting grooves 87, and the tensioner mechanism 44*a* is assembled to the tensioner housing 42*a* by both ends of the guide shaft 81 being supported by the mounting grooves 87. Incidentally, each of cable ends fixed to the driving drums 41 of the cables 24*a* and 24*b* is formed smaller than an interval between the guide wall 82*c* and the movable pulley 86, and is inserted into a space between the guide wall 82*c* and the movable pulley 86 before each of the tensioner mechanisms 44*a* and 44*b* is assembled to the case 25.

Cable incoming/outgoing portions 43*a* and 43*b* provided in the tensioner housing portion 42 are provided so that their axial directions are shifted from each other by about 90 degrees. A direction of the open-side cable 24*a* drawn out from the case 25 is orientated toward a rear side of the vehicle body 12 and in an obliquely upward direction, and a direction of the close-side cable 24*b* drawn out from the case 25 is orientated toward a front side of the vehicle body 12 and in the obliquely upward direction. The guide shaft 81 of the open-side tensioner mechanism 44*a* is disposed in a direction in which the open-side cable 24*a* is drawn out, i.e., in parallel to the open-side cable 24*a* located between the cable incoming/outgoing portion 43*a* and the movable pulley 86, and the slide portion 82*a*, i.e., the pulley holder 82 is intended to be moved along the axial direction of the guide shaft 81, i.e., along the direction in which the open-side cable 24*a* is drawn out. The guide shaft 81 of the close-side tensioner mechanism 44*b* is disposed in a direction in which the close-side cable 24*b* is drawn out, i.e., in parallel to the close-side cable 24*b* located between the cable incoming/outgoing portion 43*b* and the movable pulley 86, and the slide portion 82*a*, i.e., the pulley holder 82 is intended to be moved along the axial direction of the guide shaft 81, i.e., along the direction in which the close-side cable 24*b* is drawn. Thus, the respective guide shafts 81 of the tensioner mechanisms 44*a* and 44*b* are disposed so that the axial directions of the guide shafts 81 are shifted from each other by about 90 degrees.

In a state where the tensions are not applied to the cables 24*a* and 24*b* (state shown in FIG. 10), a terminal end portion of the guide wall 82*c* in the open-side tensioner mechanism 44*a* and a terminal end portion of the guide wall 82*c* in the close-side tensioner mechanism 44*b* are brought close to each other. That is, the guide walls 82*c* of the respective tensioner mechanisms 44*a* and 44*b* are formed within such predetermined ranges as not to interfere with each other even if the tensioner mechanisms 44*a* and 44*b* are disposed close to each other. Therefore, the tensioner mechanisms 44*a* and 44*b* can be disposed close to each other without mutually interfering with the guide walls 82*c*.

The cables 24*a* and 24*b* drawn in the tensioner housing 42*a* from the cable incoming/outgoing portions 43*a* and 43*b* are wound about the corresponding movable pulleys 86 between the cable incoming/outgoing portions 43*a* and 43*b* and the driving drum 41, respectively. The spring 84 biases the pulley holder 82 in a direction of applying the tensions to the cables 24*a* and 24*b*, i.e., in a direction in which the pulley holder 82 is separate from the cable incoming/outgoing portions 43*a* and 43*b*. Therefore, when the movement paths of the cables 24*a* and 24*b* are changed, as shown in FIG. 13, the movable pulley 86 is moved along the guide shaft 81 against a spring force of the spring 84 and the predetermined tensions are applied to the cable 24*a* and 24*b* by the tensioner mechanisms 44*a* and 44*b*.

In a state where the tension is not applied to the cable 24*a*, as shown in FIG. 14, a direction in which the cable 24*a* is drawn out from the driving drum 41, i.e., a direction of the cable 24*a* located between the driving drum 41 and the movable pulley 86 is substantially parallel to a direction in which the cable 24*a* is drawn out from the case 25, i.e., a direction of the cable 24*a* located between the cable incoming/outgoing portion 43*a* and the movable pulley 86. That is, the cable 24*a* is laid down so that a moving direction of the cable 24*a* is folded about 180 degrees by the movable pulley 86. For this reason, as shown in FIGS. 13 and 14, even if the movable pulley 86 is moved along the guide shaft 81 by the change in the tensions of the cables, the direction in which the cable 24*a* is drawn out is not changed between the cable incoming/outgoing portion 43*a* and the movable pulley 86, and the direction in which the cable 24*a* is drawn out from the driving drum 41 is also not substantially changed. Therefore, even if the movable pulley 86 is operated, the cable 24*a* is moved only within the range taken along the cable 24*a* and the moving space of the cable 24*a* can be suppressed to the minimum in the tensioner housing 42*a*. Because the movable pulley 86 is operated so that a relationship between the driving drum 41 and the cable 24*a* follows the principle of a running block, the change in the tension of the cable 24*a* can efficiently be converted into the movement of the movable pulley 86, so that operating efficiency of the tensioner mechanism 44*a* can be enhanced.

Thus, in the opening/closing apparatus 21, the movable pulleys 86 of the tensioner mechanisms 44*a* and 44*b* are disposed so that the directions in which the cables 24*a* and 24*b* are drawn out from the driving drum 41 are substantially parallel to the directions in which they are drawn out from the case 25, whereby there can be reduced a change in angles in the directions in which the cable 24*a* and 24*b* are drawn out when the movable pulleys 86 are operated. Accordingly, the moving spaces of the cables 24*a* and 24*b* involved in the operations of the movable pulleys 86 are reduced, and the opening/closing apparatus 21 can be downsized.

In the opening/closing apparatus 21, the open-side tensioner mechanism 44*a* for applying the tension to the open-side cable 24*a* and the close-side tensioner mechanism 44*b* for applying the tension to the close-side cable 24*b* are provided, and the tensioner mechanisms 44*a* and 44*b* are disposed in the tensioner housing 42*a* adjacently to each other, so that the spaces where the tensioner mechanisms 44*a* and 44*b* are disposed are reduced, and the opening/closing apparatus 21 can be reduced. In this case, the guide walls 82*c* for preventing the cables 24*a* and 24*b* from being released from the movable pulleys 86 are provided in the respective pulley holders 82, and the tensioner mechanisms 44*a* and 44*b* are disposed adjacently to the tensioner housing 42*a* so that the guide walls 82*c* are brought close to each other. Therefore, the tensioner mechanisms 44*a* and 44*b* can more efficiently be disposed in the tensioner housing 42*a*.

Further, in the opening/closing apparatus 21, the tensioner mechanisms 44*a* and 44*b* are assembled to the tensioner housing 42*a* while being previously unitized, so that the tensioner mechanisms 44*a* and 44*b* can be easily assembled to the case 25.

Next, an operation of the above-structured opening/closing apparatus 21 will be described.

When an open/close switch (not shown) is operated to an open side and an instruction signal for causing the sliding door 13 to operate in an open direction is inputted into the control substrate 47, the electromagnetic clutch 37 is switched to a connection state. Next, the electric motor 27 is driven in a normal-rotation direction to cause the driving drum 41 to rotate in a counterclockwise direction in FIG. 3, and the open-side cable 24*a* is reeled by the driving drum 41 to cause the sliding door 13 to be drawn by the open-side cable 24*a* and move toward the full-open position. Conversely, when the open/close switch is operated to a close side and an instruction signal for causing the sliding door 13 to operate in a close direction is inputted into the control substrate 47, the electromagnetic clutch 37 is switched to a connection state. Next, the electric motor 27 is driven in a reverse-rotation direction to cause the driving drum 41 to rotate in a clockwise direction in FIG. 3. The close-side cable 24*b* is reeled by the driving drum 41 to cause the sliding door 13 to be drawn by the close-side cable 24*b* and move toward the full-close position. Also, when the sliding door 13 is manually operated for opening or closing, the electromagnetic clutch 37 is switched to an intermissive state while the electric motor 27 is stopped.

On the other hand, when the sliding door 13 is automatically or manually opened and closed and the length of the movement paths of the cables 24*a* and 24*b* is changed by, example, the roller assembly 15 passing through the curve portion 14*a* of the guide rail 14, as shown in FIG. 13, the movable pulley 86 is moved along the guide shaft 81 and the tensions of the cables 24*a* and 24*b* are adjusted so as to fall within a predetermined range.

The present invention is not limited to the above-described embodiments and, needless to say, can be variously modified within a scope of not departing from the gist thereof. For example, although the open/close member is used as the sliding door 13 that are opened and closed in a sliding manner in the present embodiment, the present invention is not limited to this and there may be used other open/close members such as a horizontal hinged door for loading/unloading and a back door provided to a rear end portion of the vehicle.

Also, although the brush-equipped electric motor 27 is used as a driving source in the present embodiment, the present invention is not limited to this and may use other driving sources so long as they can drive the driving drum 41 for rotation in addition to a brushless electric motor.

Furthermore, although two cables, that is, the open-side cable 24*a* and the close-side cable 24*b* are used in the present embodiment, the present invention is not limited to this and may adopt a structure in which an intermediate portion of one cable is wound around the driving drum 41 and its both end portions are connected to the sliding door 13.

What is claimed is:

1. An automatic opening/closing apparatus for vehicle, automatically opening and closing an open/close member provided in a vehicle body, the apparatus comprising:

a case disposed in the vehicle body;

a driving rotor rotatably accommodated in the case;

a driving source attached to the case to drive the driving rotor for rotation;

a cable member whose one end side is wound about the driving rotor and whose other end is connected to the open/close member; and a tensioner mechanism accommodated in the case to apply a predetermined tension to the cable member, the tensioner mechanism comprising:

a guide shaft supported by the case;

a pulley holder movably supported on the guide shaft along the guide shaft;

a movable pulley rotatably supported by the pulley holder, the cable member being wound about the movable pulley; and a spring member supported on the guide shaft to bias the pulley holder toward a direction of applying a tension to the cable member; and wherein the case is provided with a cable incoming/outgoing portion for drawing the cable member into the case;

the guide shaft is disposed substantially in parallel to the cable member located between the cable incoming/outgoing portion and the movable pulley; and a direction of the cable member located between the driving rotor and the movable pulley is substantially parallel to the direction of the cable member located between the cable incoming/outgoing portion and the movable pulley.

2. The vehicle automatic opening/closing apparatus for vehicle according to claim 1, further comprising:

an open-side tensioner mechanism for applying a predetermined tension to an open-side cable member connected to the open/close member from its open side; and a close-side tensioner mechanism for applying a predetermined tension to a close-side cable member connected to the open/close member from its close side, wherein the tensioner mechanisms are disposed in the case adjacently to each other.

3. The vehicle automatic opening/closing apparatus for vehicle according to claim 2, further comprising arc guide walls provided in the pulley holder so as to oppose to each other and so that the arc guide walls have a predetermined space in an outer circumferential surface of the movable pulley, wherein the tensioner mechanisms are disposed in the case so that the guide walls are brought close to each other.

4. The vehicle automatic opening/closing apparatus for vehicle according to claim 2, wherein the cable incoming/outgoing portions of the open-side tensioner mechanism and the close-side tensioner mechanism and the close-side tensioner mechanism provided in the case are provided so that their axial directions are shifted from each other by about 90 degrees.

5. The vehicle automatic opening/closing apparatus for vehicle according to claim 3, wherein the guide shaft, the pulley holder, and the spring member are previously assembled in the tensioner mechanism to form one unit and the tensioner mechanism is assembled to the case while being unitized.

6. The vehicle automatic opening/closing apparatus for vehicle according to claim 2, wherein the guide shaft of the open-side tensioner mechanism and the close-side tensioner mechanism are disposed so that the axial directions are shifted from each other by about 90 degrees.

7. The vehicle automatic opening/closing apparatus for vehicle according to claim 1, wherein the guide shaft, the pulley holder, and the spring member are previously assembled in the tensioner mechanism to form one unit and the tensioner mechanism is assembled to the case while being unitized.

8. The vehicle automatic opening/closing apparatus for vehicle according to claim 2, wherein the guide shaft, the pulley holder, and the spring member are previously assembled in the tensioner mechanism to form one unit and the tensioner mechanism is assembled to the case while being unitized.

* * * * *